US008434883B2

(12) United States Patent
Doan et al.

(10) Patent No.: US 8,434,883 B2
(45) Date of Patent: May 7, 2013

(54) LLB BULB HAVING LIGHT EXTRACTING ROUGH SURFACE PATTERN (LERSP) AND METHOD OF FABRICATION

(75) Inventors: Trung Tri Doan, Baoshan Hsinchu (TW); Jui Kang Yen, Taipei (TW)

(73) Assignee: SemiOptoelectronics Co., Ltd., Chu-nan (TW)

( * ) Notice: Subject to any disclaimer, the term of this patent is extended or adjusted under 35 U.S.C. 154(b) by 0 days.

(21) Appl. No.: 13/338,524

(22) Filed: Dec. 28, 2011

(65) Prior Publication Data

US 2012/0092852 A1 Apr. 19, 2012

Related U.S. Application Data

(63) Continuation-in-part of application No. 13/303,398, filed on Nov. 23, 2011, which is a continuation-in-part of application No. 12/558,476, filed on Sep. 11, 2009, now abandoned.

(30) Foreign Application Priority Data

May 11, 2009 (TW) ..... 98115567 A

(51) Int. Cl.
*F21V 9/16* (2006.01)

(52) U.S. Cl.
USPC ..... 362/84; 362/311.02; 362/336; 362/256; 362/329

(58) Field of Classification Search ..... 362/84, 362/311.02, 326–340, 255, 256, 34, 545, 362/249.02, 311.14, 244, 246, 800; 313/317
See application file for complete search history.

(56) References Cited

U.S. PATENT DOCUMENTS

| | | | | |
|---|---|---|---|---|
| 3,868,264 | A * | 2/1975 | Kellberg et al. | 427/235 |
| 4,013,915 | A * | 3/1977 | Dufft | 313/499 |
| 4,187,274 | A | 2/1980 | Arnason | |
| 5,036,244 | A * | 7/1991 | Shaffer | 313/117 |
| 6,084,250 | A * | 7/2000 | Justel et al. | 257/89 |
| 6,352,359 | B1 * | 3/2002 | Shie et al. | 362/522 |
| 6,597,018 | B2 | 7/2003 | Nei | |
| 6,623,670 | B2 | 9/2003 | Tasaki et al. | |
| 6,799,859 | B1 | 10/2004 | Ida et al. | |
| 6,846,522 | B1 | 1/2005 | Bobrov et al. | |

(Continued)

FOREIGN PATENT DOCUMENTS

| | | |
|---|---|---|
| JP | 2005-251875 | 9/2005 |
| TW | 98115567 | 5/2009 |

OTHER PUBLICATIONS

Office Action from U.S. Appl. No. 12/558,476 dated Dec. 28, 2010, pp. 1-10.

(Continued)

*Primary Examiner* — Bao Q Truong
(74) *Attorney, Agent, or Firm* — Stephen A. Gratton

(57) ABSTRACT

A LLB bulb includes a base, a LED light source configured to emit electromagnetic radiation, and a lens/cover having a light extracting rough surface pattern (LERSP) configured to reduce glare and reflection in the LLB bulb without light loss. A method for fabricating the LLB bulb includes the steps of providing the lens/cover, and forming the light extracting rough surface pattern (LERSP) on the lens/cover. The lens/cover can be fabricated with the light extracting rough surface pattern (LERSP) using a process such as bead blasting, sand blasting, etching (chemical or plasma), or molding.

20 Claims, 4 Drawing Sheets

U.S. PATENT DOCUMENTS

| | | | | |
|---|---|---|---|---|
| 7,186,580 | B2 | 3/2007 | Tran et al. | |
| 7,193,365 | B2 | 3/2007 | Ishizaka | |
| 7,242,031 | B2 | 7/2007 | Sakai | |
| 7,473,936 | B2 | 1/2009 | Tran et al. | |
| 7,524,686 | B2 | 4/2009 | Chu et al. | |
| 7,563,625 | B2 | 7/2009 | Tran et al. | |
| 7,600,881 | B2 | 10/2009 | Sakai | |
| 7,629,195 | B2 | 12/2009 | Tran et al. | |
| 7,682,853 | B2 | 3/2010 | Ashida | |
| 7,691,659 | B2 | 4/2010 | Bader et al. | |
| 7,710,644 | B2 | 5/2010 | Kiso et al. | |
| 7,824,941 | B2 | 11/2010 | Braune et al. | |
| 7,883,226 | B2 * | 2/2011 | Li | 362/84 |
| 7,923,272 | B2 | 4/2011 | Lee | |
| 7,932,106 | B2 | 4/2011 | Li | |
| 7,977,702 | B2 | 7/2011 | Tan et al. | |
| 8,040,462 | B2 | 10/2011 | Nakagome | |
| 8,092,735 | B2 | 1/2012 | Thompson et al. | |
| 2002/0030292 | A1 | 3/2002 | Tasaki et al. | |
| 2002/0123163 | A1 | 9/2002 | Fujii | |
| 2003/0151361 | A1 | 8/2003 | Ishizaka | |
| 2003/0183553 | A1 | 10/2003 | Fujimura et al. | |
| 2005/0230698 | A1 | 10/2005 | Sakai | |
| 2006/0003477 | A1 | 1/2006 | Braune et al. | |
| 2006/0034077 | A1 * | 2/2006 | Chang | 362/227 |
| 2006/0105484 | A1 | 5/2006 | Basin et al. | |
| 2006/0105485 | A1 | 5/2006 | Basin et al. | |
| 2007/0012940 | A1 | 1/2007 | Suh et al. | |
| 2007/0199822 | A1 | 8/2007 | Bang | |
| 2007/0212802 | A1 | 9/2007 | Lee et al. | |
| 2008/0064131 | A1 | 3/2008 | Chang | |
| 2008/0079182 | A1 | 4/2008 | Thompson et al. | |
| 2009/0152573 | A1 | 6/2009 | Loh et al. | |
| 2009/0315061 | A1 | 12/2009 | Andrews | |
| 2010/0041169 | A1 | 2/2010 | Lee | |
| 2010/0109025 | A1 | 5/2010 | Bhat | |
| 2010/0283065 | A1 | 11/2010 | Yen et al. | |
| 2011/0140586 | A1 | 6/2011 | Wang | |
| 2011/0141747 | A1 * | 6/2011 | Biar | 362/311.06 |
| 2011/0286200 | A1 * | 11/2011 | Iimura et al. | 362/84 |
| 2012/0086035 | A1 | 4/2012 | Yen | |
| 2012/0273663 | A1 * | 11/2012 | Young | 250/216 |

OTHER PUBLICATIONS

Office Action from U.S. Appl. No. 12/558,476 dated Apr. 6, 2011, pp. 1-12.

Office Action from U.S. Appl. No. 12/558,476 dated Jun. 17, 2011, pp. 1-5.

Office Action from U.S. Appl. No. 12/558,476 dated Aug. 24, 2011, pp. 1-17.

U.S. Appl. No. 13/303,398, filed Nov. 23, 2011, titled "LED Device With a Light Extrating Rough Structure and Manufacturing Methods Thereof", pp. 1-22.

U.S. Appl. No. 13/165,853, filed Jun. 22, 2011, titled "Light Emitting Diode (LED) Lighting System Having Adjustable Output", pp. 1-18.

U.S. Appl. No. 13/303,398, Non-Final Office Action dated Mar. 27, 2012, pp. 1-18.

U.S. Appl. No. 13/303,398, Final Office Action dated Oct. 3, 2012, pp. 1-8.

* cited by examiner

LLB BULB HAVING LIGHT EXTRACTING ROUGH SURFACE PATTERN (LERSP) AND METHOD OF FABRICATION

CROSS REFERENCE TO RELATED APPLICATIONS

This application is a continuation-in-part of application Ser. No. 13/303,398 filed Nov. 23, 2011, which is a continuation-in-part of application Ser. No. 12/558,476 filed Sep. 11, 2009, which claims priority from Taiwan application no. 98115567 filed May 11, 2009.

BACKGROUND

This disclosure relates generally to light emitting diode (LED) lighting systems and more particularly to light emitting diode light bulbs (LLB).

LLB bulbs have been developed that are interchangeable with conventional light bulbs having incandescent and fluorescent light sources. A LLB bulb typically includes a base, a power supply, a LED light source on the base having one or more LED light sources, and a lens/cover. Advantageously, LLB bulbs have higher conversion efficiencies, longer lifetimes and lower operating voltages than conventional light bulbs.

One aspect of LLB bulbs is that light reflection can occur from the inner or outer surface of the lens/cover. In particular, if the angle of incidence of light from the LED light source to the lens/cover is less than a critical angle, then light can be transmitted through the lens/cover. If the angle of incidence is greater than the critical angle, the light reflects from the lens back to the LED light source. In addition, a LLB bulb having a very bright LED light source, such as a packaged light emitting diode (PLED), can produce glare. Glare is unpleasant and makes it difficult for a person's eyes to see correctly. Briefly, glare is caused by a significant ratio of luminance between the task (that which is being looked at) and the glare source. Factors such as the angles between the task, the glare source and the eyes also have a significant impact on glare.

Glare can generally be divided into two types, discomfort glare and disability glare. Discomfort glare causes an instinctive desire to look away from a bright light source making the task more difficult to see. Disability glare renders the task impossible to view, such as when driving westward at sunset. Disability glare is often caused by the inter-reflection of light within the eyeball, reducing the contrast between the task and the glare source to the point where the task cannot be distinguished. When glare is so intense that vision is completely impaired, it is sometimes called dazzle. Because of bright glare from a LLB having a PLED light source, some LLB bulbs include lens/covers made of semi-transparent (ST) plastic or glass. However, these semi-transparent materials also reduce the light output of a LLB bulb. LLB bulbs can also have a lens/cover with a built in particle diffuser. Although particle diffusers reduce reflection, they also reduce the light output of the LLB bulb. The present disclosure is directed to LLB bulbs having a lens/cover with a light extraction surface that reduces glare and reflection with minimal light loss, producing improved light output from the LLB bulbs with reduced glare.

SUMMARY

A LLB bulb includes a base, a LED light source on the base configured to emit electromagnetic radiation, and a lens/cover having a light extracting rough surface pattern (LERSP) configured to reduce glare and reflection in the LLB bulb without reducing the output of electromagnetic radiation from the LLB bulb. The LLB bulb can also include a wavelength conversion layer (or lens) for changing the electromagnetic radiation output of the LLB bulb. For example, the LED light source can be configured to emit electromagnetic radiation from a blue spectral range, and the wavelength conversion layer (or lens) can be configured to convert some of the electromagnetic radiation into a yellow spectral range. The combination of radiation from the blue spectral range and the yellow spectral range produces an electromagnetic radiation output for the LLB bulb corresponding to a perceived white light having a particular color temperature.

A method for fabricating the LLB bulb includes the steps of providing the lens/cover, and forming the light extracting rough surface pattern (LERSP) on the lens/cover. Suitable processes for forming the light extracting rough surface pattern (LERSP) include bead blasting, sand blasting, etching (chemical or plasma) and molding.

BRIEF DESCRIPTION OF THE DRAWINGS

Exemplary embodiments are illustrated in the referenced figures of the drawings. It is intended that the embodiments and the figures disclosed herein are to be considered illustrative rather than limiting.

DETAILED DESCRIPTION

As used herein, the term "LERSP" means light extracting rough surface pattern. As used herein, the term "rough" means a surface having multi-faceted symmetrical or non-symmetrical features containing points, ridges and multifaceted edges and angles. As used herein, the term "millimeter roughness" means the dimensions of the features, such as the height, the width and the spacing, are measured in millimeters. As used herein, the term "micron roughness" means the dimensions of the features are measured in microns. As used herein, the term "submicron roughness" means the dimensions of the features are less than about one micron (1000 nm). As used herein, the term "high aspect ratio" means that the average ratio of height to width of a feature is greater than about 2. It is to be understood that when an element is stated as being "on" another element, it can be directly on the other element or intervening elements can also be present. However, the term "directly" means there are no intervening elements. In addition, although the terms "first", "second" and "third" are used to describe various elements, these elements should not be limited by the term. Also, unless otherwise defined, all terms are intended to have the same meaning as commonly understood by one of ordinary skill in the art.

Figure 1A:
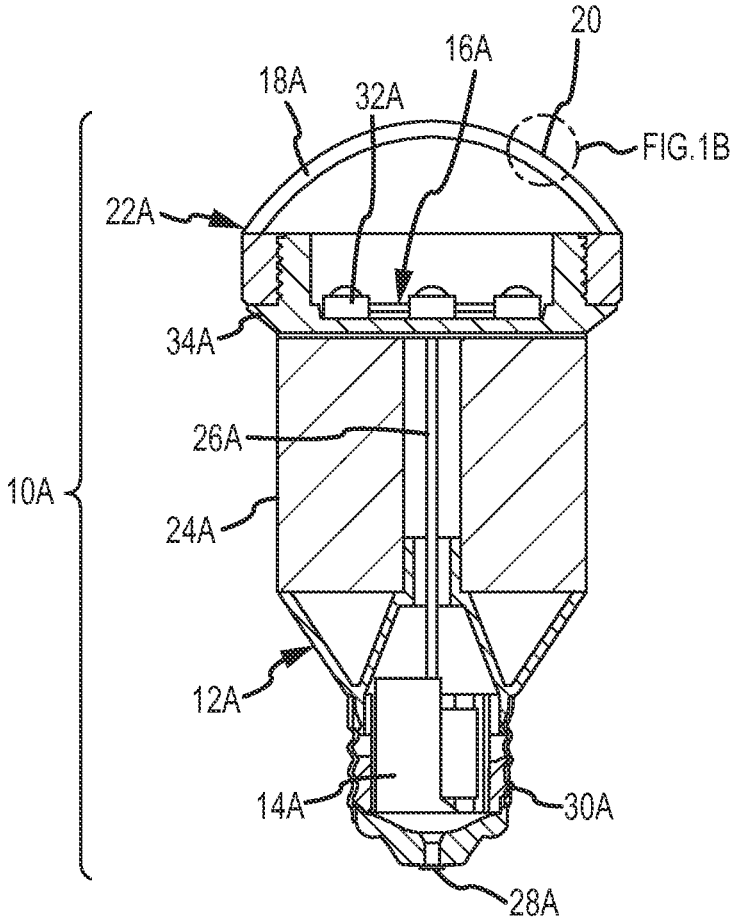
FIG. 1A is a schematic cross sectional view of a LLB bulb having a lens/cover with a LERSP on an outside surface thereof.
Figure 1B:
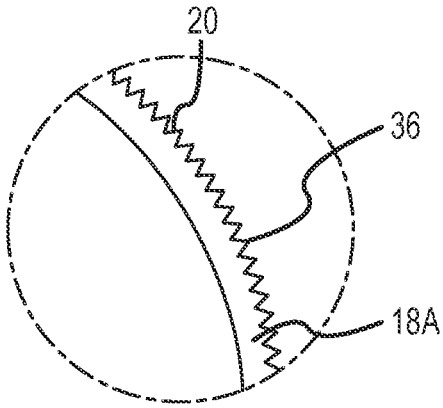
FIG. 1B is an enlarged schematic cross sectional view taken along line 1B of FIG. 1A illustrating a lens/cover with a LERSP on an outside surface thereof.
Figure 1C:
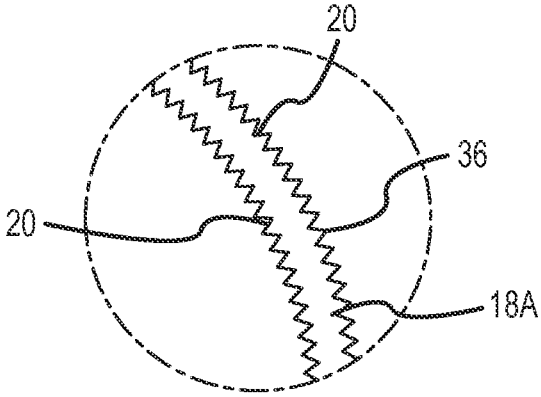
FIG. 1C is an enlarged schematic cross sectional view equivalent to FIG. 1A illustrating the lens/cover with a LERSP on both the outside and inside surfaces thereof.

Referring to FIGS. 1A-1B, a LLB bulb 10A includes a base 12A having a power supply 14A, and an LED light source 16A mounted to the base 12A in electrical communication with the power supply 14A configured to emit electromagnetic radiation having a selected wavelength. The LLB bulb 10A also includes a lens/cover 18A attached to the base 12A having a light extracting rough surface pattern LERSP 20 (FIG. 1B). As shown in FIG. 1B, the LERSP 20 can be formed on the outside surface of the lens/cover 18A. Alternately, as shown in FIG. 1C, an inner LERSP 20 can be formed on just the inside surface of the lens/cover 18A, or on both the inside surface and the outside surface of the lens/cover 18A. In addition, although the LLB bulb 10A is disclosed with a particular configuration, it can have any light bulb configuration including but not limited to spotlight, form factor, vivid, miniature, subminiature, Dulux, u-shape, circline, octron, slimline, automotive and special purpose.

The LLB bulb 10A also includes a threaded ring 22A attached to the lens/cover 18A configured to attach the lens/cover 18A to the base. In addition, the lens/cover 18A attaches to the threaded ring 22A using a suitable attachment mechanism such as an adhesive or threads (not shown). The threaded ring 22A can include female threads that mate with the male threads on the base 12A. Alternately, rather than having threads, the threaded ring 22A can include other attachment features such as screws, snap fits, press fits, compression rings, snap taps, adhesives or various fasteners known in the art.

As shown in FIG. 1A, the base 12A has a metal screw cap configuration with an electrical contact 28A at the tip and continuous threaded contacts 30A that also provide mechanical support in a mating socket. Alternately, the base 12A can have other contact arrangements such as bayonet, candelabra, mogul, or screw terminals for connection to wires. The base 12A also includes the power supply 14A for the LED light source 16A, which can include an AC-DC converter, a driver circuit and any other electrical components necessary for operating the LED light source 16A. The base 12A also includes a heat sink 24A in thermal communication with the LED light source 16A and wires 26A that electrically connect the LED light source 16A to the contacts 28A, 30A. The base 12A also includes a threaded connector 34A having male threads that mate with female threads on the threaded ring 22A. The elements of the base 12A can be combined into a unitary structure using fabrication techniques that are known in the art such as machining, casting and attaching the individual elements.

The LED light source 16A can include one or more LED devices 32A, such as LED dice or PLED, configured to emit electromagnetic radiation having a selected wavelength range. For example, each LED device 32A can be configured to emit electromagnetic radiation from the visible spectral region (e.g., 400-770 nm), the violet-indigo spectral region (e.g., 400-450 nm), the blue spectral region (e.g., 450-490 nm), the green spectral region (e.g., 490-560 nm), the yellow spectral region (e.g., 560-590 nm), the orange spectral region (e.g., 590-635 nm) or the red spectral region (e.g., 635-700 nm). The LED devices 32A can also include a wavelength conversion layer, such as a layer of phosphor, configured to convert at least some of the electromagnetic radiation from the device to produce a perceived white light having a selected color temperature (e.g., warm, neutral, cool). In addition, each LED device 32A can include a light extracting rough structure on it's individual lens, as described in parent application Ser. No. 13/303,398, which is incorporated herein by reference.

The lens/cover 18A can be configured to protect the LED light source 16A, and can also be configured to collimate or focus the electromagnetic radiation emitted by the LED light source 16A. The lens/cover 18A can comprise a transparent, or a semi-transparent material, such as a plastic (e.g., polycarbonate), or a glass, formed in a desired shape. For example, the lens/cover 18A can have a semi-circular or concave shape as shown, or any other suitable shape (e.g., flat, tubular, rectangular, dome, convex).

As shown in FIG. 1B, the lens/cover 18A includes the LERSP 20 formed on the outside surface thereof. Alternately, as shown in FIG. 1C, a LERSP 20 can be formed on just the inside surface or on both the inside and outside surfaces of the lens/cover 18A. In addition, the LERSP 20 can be formed over the entire outside area of the lens/cover 18A, or multiple separate LERSPs 20 can be formed on selected portions of the lens/cover 18A. The LERSP 20 can have a textured morphology comprised of a plurality of symmetrical or non-symmetrical features 36. For example, the features 36 can have a jagged, multifaceted, pyramidal, conical or semi-rounded morphology configured to optimally scatter the electromagnetic radiation emitted by the LED light source 16A. As another example, the features 36 can be rough and non-symmetrical thereby increasing the number and type of edges or angles presented on the surface of the lens/cover 18A for enhancing electromagnetic extraction and reducing glare and reflection without reducing the output of the LLB bulb 10A. By way of example and not limitation, the features can have an aspect ratio of about 2 to about 10 A, an average diameter and spacing of about 10 nm to about 200 nm and a depth or a height of from about 0.1 μm to about 50 μm.

The LERSP 20 can be formed using a suitable process such as bead blasting, sand blasting, etching (chemical or plasma), or molding. In addition, each of the processes can be controlled such that the features 36 have a high aspect ratio and a sum-millimeter, micron or submicron roughness configured to improve light extraction and to direct the electromagnetic radiation outward from the light bulb. U.S. Pat. Nos. 7,186,580 B2; 7,473,936 B2; 7,524,686 B2; 7,563,625 B2 and 7,629,195 B2, all of which are incorporated herein by reference, disclose a photo-electrochemical (PEC) oxidation and etching process for fabricating light emitting diodes (LEDs) with a rough surface. This process can also be used to form the LERSP 20 on the lens/cover 18A. In the case of molding, parent application Ser. No. 13/303,398 describes a molding process wherein the mold includes a rough inner surface configured to mold the lenses for LED device with a rough surface. In this case, the rough inner surface of the mold can be made using a suitable process such as machining or etching. This molding process can be used to mold the lens/cover 18A with LERSP 20.

Figure 2:
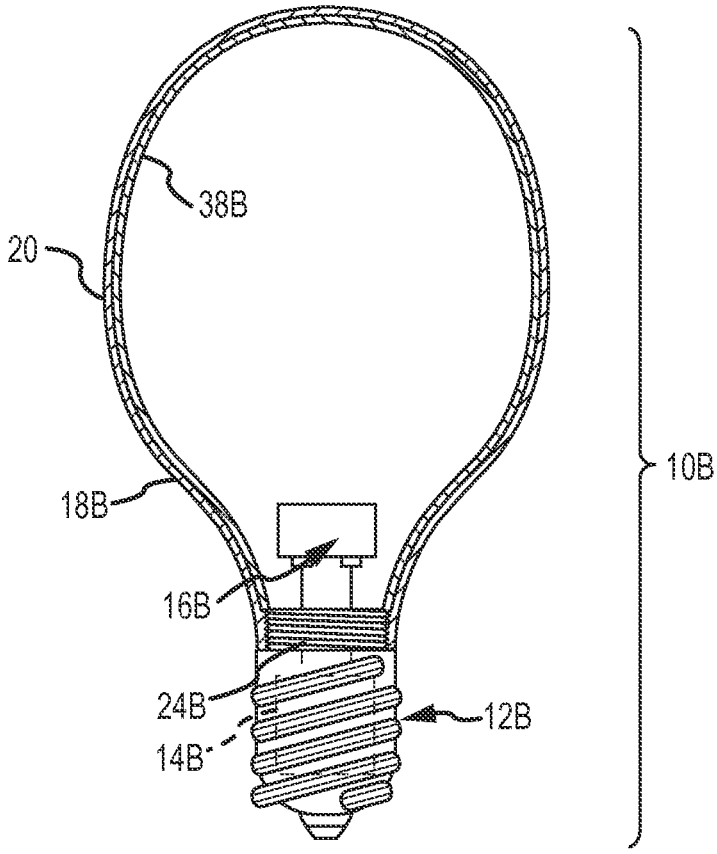
FIG. 2 is a schematic cross sectional view of a second LLB bulb having a lens/cover with a LERSP on an outside surface thereof and a wave length conversion layer on an inside surface thereof configured to produce a perceived white light having a selected color temperature.

Referring to FIG. 2, a second LLB bulb 10B has an "A-type" form factor light bulb. The LLB bulb 10B includes a base 12B having a power supply 14B, a LED light source 16B mounted to the base 12B in electrical communication with the power supply 14B configured to emit electromagnetic radiation having a selected wavelength range, a heat sink 24B on the base 12B, and a lens/cover 18B containing a light extracting rough surface pattern (LERSP) 20 on an outer surface thereof, and a wavelength conversion layer 38B on an inner surface thereof.

The base 12B has a metal screw cap configuration with an electrical contact 28B at the tip and threaded contacts 30B, which also provide mechanical support in a mating socket.

Alternately, the base 12B can have other contact arrangements such as bayonet, candelabra, mogul, or screw terminals for connection to wires. The base 12B also includes the power supply 14B for the LED light source 16B, which can include an AC-DC converter, a driver circuit and any other electrical components necessary for operating the LED light source 16B.

The lens/cover 18B can comprise a transparent, or a semi-transparent material, such as a plastic (e.g., polycarbonate), or a glass, formed in a desired shape. For example, the lens/cover 18B can have a bulbous shape as shown, or can have any other suitable shape (e.g., tubular, rectangular, dome, convex, concave).

The wavelength conversion layer 38B can comprise a layer of material configured to convert at least some of the electromagnetic radiation produced by the LED light source 16B into electromagnetic radiation having a different wavelength. For example, the wavelength conversion layer 38B can comprise a layer of phosphor which covers the inside surface of the lens/cover 18B. The electromagnetic radiation emitted by the LED light source 16B combined with the electromagnetic radiation converted by wavelength conversion layer 38B produces the electromagnetic radiation produced by the LLB bulb 10B. The wavelength conversion layer 38B can be deposited on the cover lens/cover 18B using a suitable process such as spraying, dipping, spin coating, rolling, electro deposition or vapor deposition to a desired thickness. Rather than being a deposited layer, the wavelength conversion layer 38B can also be incorporated into the material of the lens/cover 18B using a suitable process, such as mixing with a molded plastic material or a rolled glass material. As with the previous LLB bulb 10A (FIG. 1A), the LLB bulb 10C is configured to reduce glare and reflection with minimal light loss.

Figure 3:
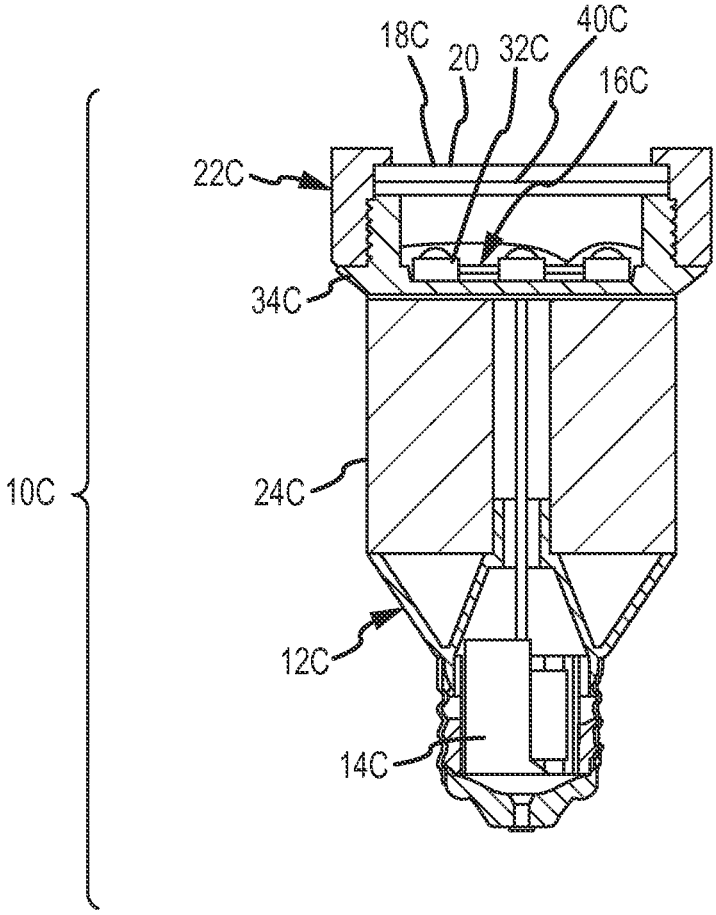
FIG. 3 is a schematic cross sectional view of a third LLB bulb having a lens/cover with a LERSP on an outside surface thereof and a separate wavelength conversion lens configured to produce a perceived white light having a selected color temperature.

Referring to FIG. 3, a third LLB bulb 10C is substantially similar to the LLB bulb 10 (FIG. 1A), but includes a removable lens/cover 18C having a light extracting rough surface pattern LERSP 20 on an outer surface thereof and a wavelength conversion lens 40C in contact with an inner surface thereof. The LLB bulb 10C also includes a base 12C having a power supply 14C, a LED light source 16C mounted to the base 12C having a plurality of LED devices 32C configured to emit electromagnetic radiation having a selected wavelength range, and a heat sink 24C on the base 12C. The LLB bulb 10C also includes a threaded ring 22C having female threads that mate with the male threads on a threaded connector 34C attached to the base 12C. The threaded ring 22C is configured to retain the lens/cover 18C and the wavelength conversion lens 20C but is removable so that the wavelength conversion lens 20C can be removed and replaced with a different wavelength conversion lens. This feature is further described in application Ser. No. 13/165,853 filed Jun. 22, 2011, which is incorporated herein by reference.

The wavelength conversion lens 40C can comprise a transparent, or a semi-transparent material, such as a plastic or a glass, formed in a desired shape, such as the flat circular shape shown. The wavelength conversion lens 40C includes a material configured to convert at least some of the electromagnetic radiation emitted by the LED light source 16C into electromagnetic radiation having a different wavelength range. For example, the wavelength conversion lens 40C can include a layer of material, covering one or more major surfaces thereof, configured to convert the electromagnetic radiation emitted by the LED light source 16C into electromagnetic radiation having a higher wavelength. For example, if the LED light source 16C emits electromagnetic radiation in a blue spectral range, the wavelength conversion lens 40C can include a phosphor layer for converting some of this radiation to a yellow spectral range. A layer of phosphor can be deposited using a suitable process such as spraying, dipping, spin coating, rolling, electro deposition or vapor deposition to a desired thickness. Rather than being a deposited layer, wavelength conversion material, such as phosphor, can also be incorporated into the material of the wavelength conversion lens 40C using a suitable process, such as mixing with a molded plastic material or a rolled glass material.

The electromagnetic radiation emitted by the LED light source 16C combined with the electromagnetic radiation converted by the wavelength conversion lens 40C produces an electromagnetic radiation output for the LLB bulb 10C. In addition, this electromagnetic radiation output can be selected to achieve a perceived light color. For example, the LED light source 16C and the wavelength conversion lens 40C can be configured such that the LLB bulb 10C emits a perceived white light having a selected color temperature. In addition, by interchanging the wavelength conversion lens 40C a user can vary the color of the light emitted by the LLB bulb 10C. For example, white light can have many degrees of white that are described by a Kelvin temperature. Color temperatures over 5,000 K are called cool colors (blueish white), while lower color temperatures (2,700-3,000 K) are called warm colors (yellowish white through red). The user and install a particular lens to produce a desired white light output.

Thus the disclosure describes an improved LLB bulb having a lens/cover with a light extracting rough surface pattern. While a number of exemplary aspects and embodiments have been discussed above, those of skill in the art will recognize certain modifications, permutations, additions and subcombinations thereof. It is therefore intended that the following appended claims and claims hereafter introduced are interpreted to include all such modifications, permutations, additions and sub-combinations as are within their true spirit and scope.

What is claimed is:

1. A light emitting diode bulb comprising:

a base;

a LED light source on the base comprising at least one light emitting diode (LED) device configured to emit electromagnetic radiation in a wavelength range;

a lens/cover on the base;

a light extracting rough surface pattern on a surface of the lens/cover comprising a plurality of features having a jagged, multifaceted, pyramidal, conical or semi-rounded morphology with an aspect ratio of from 2-10 Å, an average diameter and spacing of from 10-200 nm, and a depth or a height of from 0.1-50 μm configured to reduce glare and reflection of the electromagnetic radiation; and a wavelength conversion layer on the lens/cover configured to change the wavelength range of the electromagnetic radiation emitted by the light emitting diode (LED) device, with the wavelength range and the wavelength conversion layer configured to produce a selected light output for the light emitting diode light bulb.

2. The light emitting diode light bulb of claim 1 wherein the wavelength conversion layer is incorporated into a material of the lens/cover.

3. The light emitting diode light bulb of claim 1 wherein the features are formed on an outer surface of the lens/cover and the wavelength conversion layer is formed on an inner surface of the lens/cover.

4. The light emitting diode light bulb of claim 1 wherein the features are formed on an inner surface of the lens/cover and the wavelength conversion layer is formed on an outer surface of the lens/cover.

5. The light emitting diode light bulb of claim 1 wherein the features are formed on both an inner surface and an outer surface of the lens/cover and the wavelength conversion layer is incorporated into a material of the lens/cover.

6. The light emitting diode light bulb of claim 1 wherein the light emitting diode (LED) device comprises a light emitting diode (LED) die or a packaged light emitting diode (PLED).

7. The light emitting diode light bulb of claim 1 wherein the selected light output for the light emitting diode light bulb comprises a perceived white light having a selected color temperature.

8. The light emitting diode light bulb of claim 1 wherein the jagged, multifaceted, pyramidal, conical or semi-rounded morphology is configured to optimally scatter the electromagnetic radiation.

9. A light emitting diode bulb comprising:

a base;

a LED light source on the base comprising at least one light emitting diode (LED) device configured to emit electromagnetic radiation in a wavelength range;

a lens/cover on the base having a light extracting rough surface pattern comprising a plurality of features formed on a surface thereof having a jagged, multifaceted, pyramidal, conical or semi-rounded morphology configured to scatter the electromagnetic radiation and to reduce glare and reflection of the electromagnetic radiation without reducing transmission of the electromagnetic radiation through the lens/cover, the features having an aspect ratio of from 2-10 Å, an average diameter and spacing of from 10-200 nm, and a depth or a height of from 0.1-50 μm; and a wavelength conversion layer on the lens/cover configured to change the wavelength range of the electromagnetic radiation emitted by the light emitting diode (LED) device, with the wavelength conversion layer and the light emitting diode (LED) device configured to produce a perceived white light having a selected color temperature.

10. The light emitting diode light bulb of claim 9 wherein the selected color temperature comprises warm, neutral or cool.

11. The light emitting diode light bulb of claim 9 wherein the wavelength conversion layer is incorporated into a material of the lens/cover.

12. The light emitting diode light bulb of claim 9 wherein the lens/cover has a configuration selected from the group consisting of spotlight, form factor, vivid, miniature, subminiature, Dulux, u-shape, circline, octron, slimline, automotive and special purpose.

13. The light emitting diode light bulb of claim 9 wherein the light emitting diode (LED) device includes a device lens having a light extracting rough structure.

14. The light emitting diode light bulb of claim 9 wherein the light emitting diode (LED) device includes a phosphor layer configured to change the wavelength range.

15. A method for fabricating a light emitting diode light bulb comprising:

providing a base and a LED light source on the base comprising at least one light emitting diode (LED) device configured to emit electromagnetic radiation having a wavelength range;

providing a lens/cover for the base;

forming a light extracting rough surface pattern on the lens/cover comprising a plurality of features having a jagged, multifaceted, pyramidal, conical or semi-rounded morphology with an aspect ratio of from 2-10 Å, an average diameter and spacing of from 10-200 nm, and a depth or a height of from 0.1-50 μm configured to reduce glare and reflection of the electromagnetic radiation without reducing transmission of the electromagnetic radiation through the lens/cover; and forming a wavelength conversion layer on the lens/cover configured to change the wavelength range of the electromagnetic radiation emitted by the light emitting diode (LED) device to produce a perceived white light having a selected color temperature.

16. The method of claim 15 wherein the forming the light extracting rough surface pattern step comprises a method selected from the group consisting of bead blasting, sand blasting, etching and molding.

17. The method of claim 15 wherein the forming the rough surface step comprises a photo-electrochemical (PEC) oxidation and etching process.

18. The method of claim 15 wherein the light emitting diode (LED) device includes a device lens with a light extracting rough structure.

19. The method of claim 15 the light emitting diode (LED) device includes a phosphor layer configured to change the wavelength range.

20. The method of claim 15 wherein the selected color temperature comprises warm, neutral or cool.

* * * * *